US007708111B2

(12) United States Patent
Uryu et al.

(10) Patent No.: US 7,708,111 B2
(45) Date of Patent: May 4, 2010

(54) ACOUSTIC DIAPHRAGM AND METHOD FOR MANUFACTURING AN ACOUSTIC DIAPHRAGM

(75) Inventors: Masaru Uryu, Chiba (JP); Kunihiko Tokura, Tokyo (JP); Takahisa Tagami, Kanagawa (JP); Emiko Ikeda, Tokyo (JP)

(73) Assignee: Sony Corporation, Tokyo (JP)

( * ) Notice: Subject to any disclaimer, the term of this patent is extended or adjusted under 35 U.S.C. 154(b) by 485 days.

(21) Appl. No.: 11/486,003

(22) Filed: Jul. 14, 2006

(65) Prior Publication Data

US 2007/0017737 A1 Jan. 25, 2007

(30) Foreign Application Priority Data

Jul. 21, 2005 (JP) ..... 2005-211525

(51) Int. Cl.

| | |
|---|---|
| ***G10K 13/00*** | (2006.01) |
| ***H04R 7/10*** | (2006.01) |
| *H04R 7/02* | (2006.01) |
| *H04R 7/06* | (2006.01) |

(52) U.S. Cl. ..... 181/169; 181/167; 181/170; 381/426; 381/428

(58) Field of Classification Search ..... 181/169, 181/167, 170; 381/426, 428

See application file for complete search history.

(56) References Cited

U.S. PATENT DOCUMENTS

| | | | | | |
|---|---|---|---|---|---|
| 1,984,019 | A * | 12/1934 | Hawley | 181/165 |
| 4,140,203 | A * | 2/1979 | Niguchi et al. | 181/167 |
| 4,291,781 | A * | 9/1981 | Niguchi et al. | 181/169 |
| 4,471,085 | A * | 9/1984 | Yamamoto et al. | 524/449 |
| 4,742,164 | A * | 5/1988 | Iguchi et al. | 536/56 |
| 5,031,720 | A * | 7/1991 | Ohta et al. | 181/169 |
| 5,380,960 | A * | 1/1995 | Fontaine | 181/167 |
| 7,010,143 | B2 * | 3/2006 | Kam | 381/426 |
| 2003/0223613 | A1 * | 12/2003 | Hachiya | 381/423 |
| 2004/0112672 | A1 * | 6/2004 | Ono et al. | 181/169 |
| 2005/0051380 | A1 * | 3/2005 | Takayama et al. | 181/170 |
| 2005/0257998 | A1 * | 11/2005 | Sato et al. | 181/167 |
| 2007/0131478 | A1 * | 6/2007 | Okazaki et al. | 181/167 |

FOREIGN PATENT DOCUMENTS

| | | | |
|---|---|---|---|
| JP | 54151022 | A * | 11/1979 |
| JP | 03107300 | A * | 5/1991 |
| JP | 7-28476 | | 3/1995 |

* cited by examiner

*Primary Examiner*—Edgardo San Martin
(74) *Attorney, Agent, or Firm*—Oblon, Spivak, McClelland, Maier & Neustadt, L.L.P.

(57) ABSTRACT

There is provided an acoustic diaphragm which includes a diaphragm base material composed of a paper article comprised of fine mica flakes, pulp fibers, and polyvinyl alcohol fibers and formed to be a multi-cellular structure; and a sheet material combined with the paper article or the diaphragm base material.

12 Claims, 7 Drawing Sheets

ACOUSTIC DIAPHRAGM AND METHOD FOR MANUFACTURING AN ACOUSTIC DIAPHRAGM

CROSS REFERENCES TO RELATED APPLICATIONS

The present document contains subject matter related to Japanese Patent Application JP 2005-211525 filed in the Japanese Patent Office on Jul. 21, 2005, the entire contents of which being incorporated herein by reference.

BACKGROUND OF THE INVENTION

1. Field of the Invention

The present invention relates to an acoustic diaphragm used in a loudspeaker and others and a method for manufacturing an acoustic diaphragm.

2. Description of Related Art

Requirements of a diaphragm for loudspeaker having excellent reproduction frequency characteristics are such that the Young's modulus and internal loss be large and the density be low. For example, the reproduction frequency band can be extended by increasing the Young's modulus of a diaphragm, and the reproduction frequency characteristics can be flattened by increasing the internal loss of the diaphragm to lower the quality factor. In addition, the reproduction efficiency can be improved by lowering the density of the diaphragm. For meeting the requirements of the diaphragm, the use of a so-called mica paper multi-cellular structure product in a diaphragm for loudspeaker has been proposed wherein the mica paper multi-cellular structure product is prepared by making paper from fine mica flakes and pulp fibers or polyvinyl alcohol fibers and then heating the paper to form a multi-cellular structure.

The thus prepared mica paper multi-cellular structure product has an apparent density as small as 0.05 to 0.60 g/cm$^3$ and hence can achieve a lightweight diaphragm. Further, the fine mica flakes used in the multi-cellular structure product have a large ratio of the area to the thickness (that is, a so-called aspect ratio is large), and therefore the areas with which the mica flakes are stacked on one another are large. For this reason, the mica paper multi-cellular structure product has a large Young's modulus.

However, this multi-cellular structure product has a small internal loss and hence increases the resonance sharpness, making it difficult to obtain flat reproduction frequency characteristics. For solving this problem, a method has been proposed in Examined Japanese Patent Application Publication (KOKOKU) No. 7-28476 (Patent Document 1), in which the mica paper multi-cellular structure product is impregnated with a synthetic resin solution or synthetic resin emulsion to be coated with an extremely thin resin film, lowering the internal loss

SUMMARY OF THE INVENTION

However, in the technique described in the Patent document 1, the synthetic resin solution or synthetic resin emulsion used in coating the mica paper multi-cellular structure product contains an organic solvent, a surfactant, or the like, and environmental problems of this technique have been pointed out.

By the way, a related art mica paper multi-cellular acoustic diaphragm is manufactured by the following method. First, fine mica flakes, pulp fibers, and polyvinyl alcohol fibers are mixed together and uniformly dispersed in water, followed by papermaking using a paper machine or the like. Then, the resultant paper article in a moisture state is placed in a mold and heated to 100° C. or higher to dissolve the polyvinyl alcohol fibers. Finally, the whole of the article is dried to obtain a mica paper multi-cellular acoustic diaphragm.

In forming the mica paper multi-cellular structure product from the paper article, first, at a point in time when the temperature of the paper article has reached 80° C. or higher, the polyvinyl alcohol fibers are dissolved in moisture contained in the paper article into liquid and the liquid flows as a binder between the fine mica flakes and the pulp fibers. Then, at a point in time when the temperature has reached 100° C. or higher, the moisture vaporizes into water vapor to generate bubbles, thus forming a multi-cellular structure. In this instance, the water vapor is discharged through drying pores of the mold.

However, a problem occurs in that the polyvinyl alcohol which has changed into liquid during the above procedure flows into the drying pores of the mold, making difficult removal of the resultant mica paper multi-cellular structure product from the mold, i.e., so-called release. Accordingly, the present invention provides an acoustic diaphragm which is advantageous not only in that the diaphragm is free of environmental problems and has an internal loss effectively increased to achieve flat reproduction frequency characteristics, but also in that the diaphragm has improved releasability from a mold in the production of the diaphragm, and a method for manufacturing the acoustic diaphragm.

For solving the above problems, an acoustic diaphragm according to an embodiment of the present invention includes: a diaphragm base material having a multi-cellular structure obtained from a paper article composed of fine mica flakes, pulp fibers, and polyvinyl alcohol fibers; and a sheet material combined with the paper article or the diaphragm base material.

A method for manufacturing an acoustic diaphragm according to an embodiment of the present invention includes the following steps of: forming a paper article; combining a sheet material with the paper article; heating the paper article and the sheet material; and forming a diaphragm base material having a multi-cellular structure from the paper article. In the method, the paper article is composed of fine mica flakes, pulp fibers, and polyvinyl alcohol fibers, and only water vapor contained in the paper article is discharged through the sheet material.

In the acoustic diaphragm and the method for manufacturing an acoustic diaphragm of the present invention, a sheet material having an internal loss larger than that of the mica paper multi-cellular diaphragm is combined with the paper article in a mold during the manufacture of the mica paper multi-cellular diaphragm, or a sheet material is combined with the diaphragm base material surface of the thus manufactured mica paper multi-cellular diaphragm, and therefore both flattening the reproduction frequency characteristics and improving the releasability from a mold can be achieved.

BRIEF DESCRIPTION OF THE DRAWINGS

FIG. 2 includes diagrammatic views of a diaphragm for loudspeaker, in which

DETAILED DESCRIPTION OF THE INVENTION

Hereinbelow, embodiments of the present invention will be described in detail with reference to the accompanying drawings.

Figure 1:
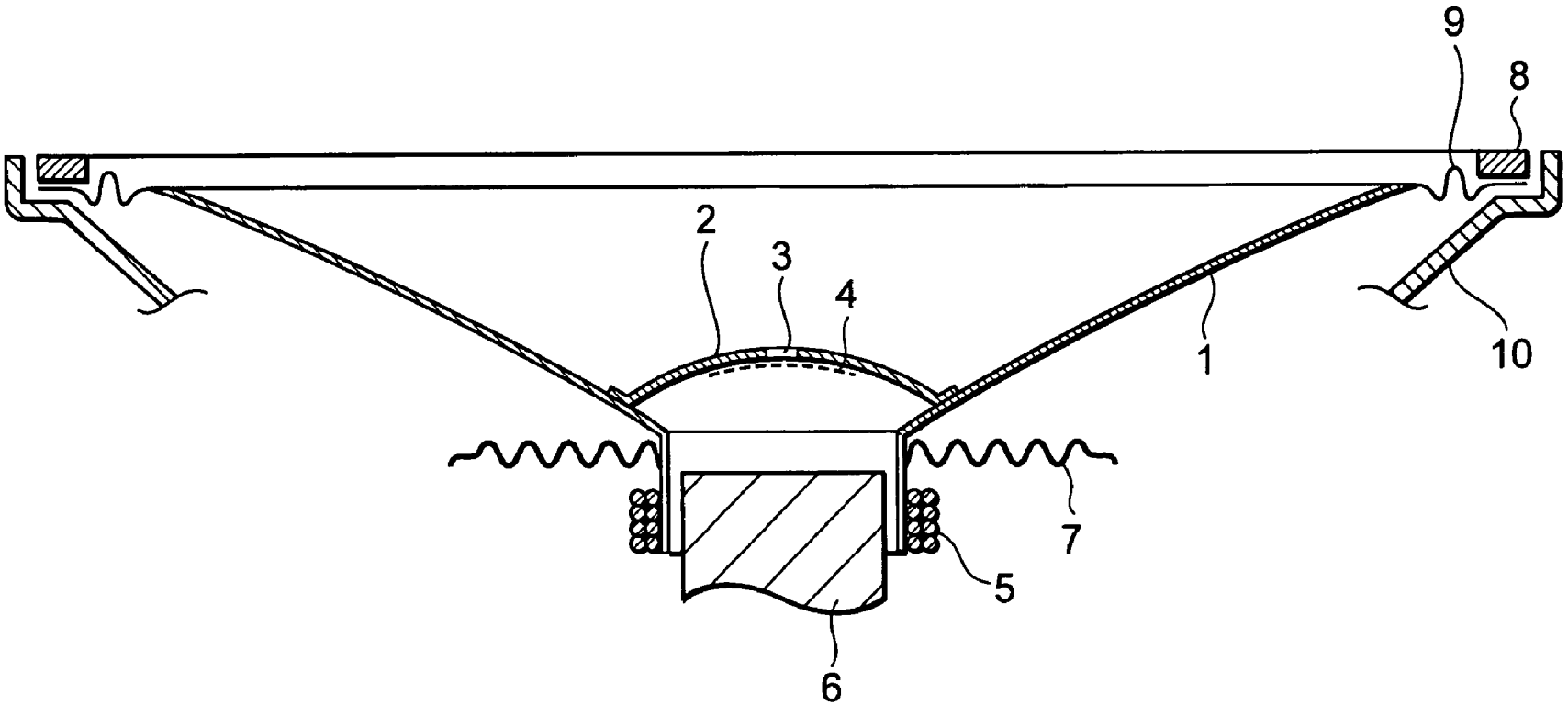
FIG. 1 is an explanatory view of a loudspeaker vibrating portion.

FIG. 1 is an explanatory view of a loudspeaker vibrating portion. As shown in FIG. 1, a loudspeaker unit has a loudspeaker vibrating portion. In FIG. 1, a cone 1 constituting a diaphragm for loudspeaker is made from a material which can be shaped into a thin form for facilitating the movement and is lightweight and stiff, and which provides an appropriate loss called internal loss for suppressing peak dips in the frequency characteristics or transient properties.

A center cap 2 is provided for preventing the cone 1 from deforming in the radial direction and preventing iron powder or dust from entering the voids. The center cap 2 has a hole 3 formed in its center, and the hole 3 is covered with open weave 4. The hole 3 allows air, which is pressed or expanded due to the vibration of the cone 1, to escape.

The open weave 4 prevents dust from entering the inside without inhibiting the flow of air. Voice coils 5 move up and down along the periphery of a pole 6 to vibrate the cone 1. Dampers 7 keep the voice coils 5 appropriately at the periphery of the pole 6. A gasket 8 fixes an edge 9 of the cone 1 to a frame 10.

Figure 2B:
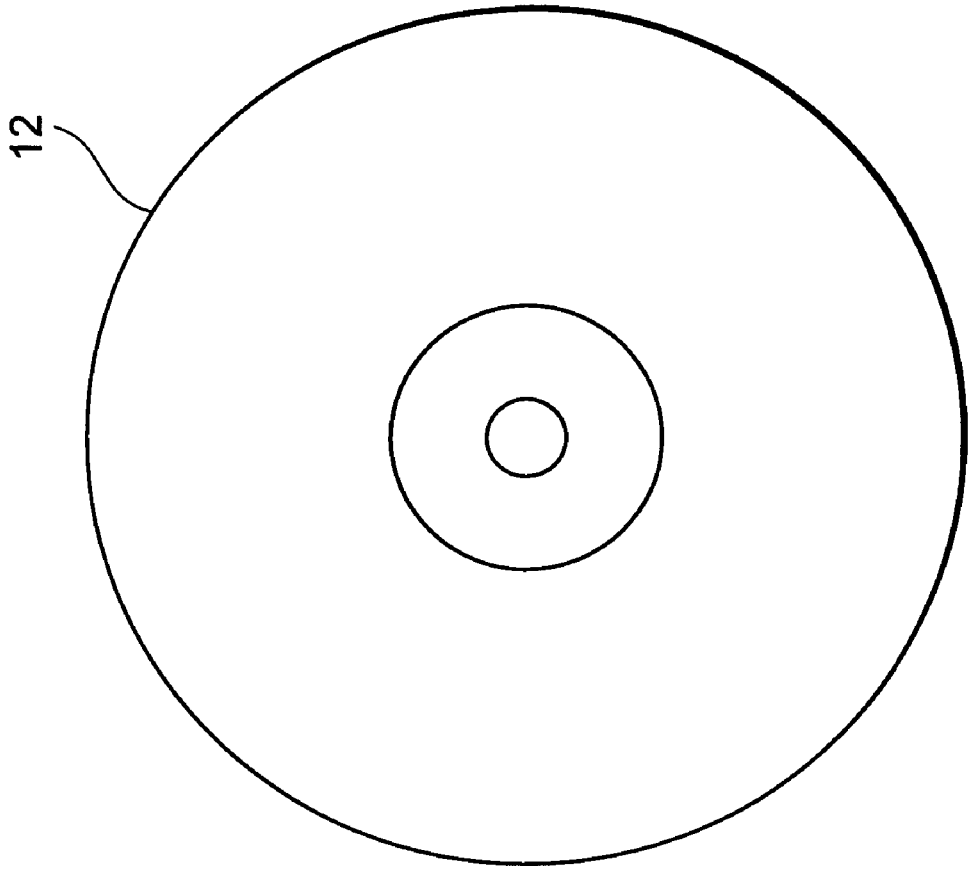
FIG. 2A is a side view and FIG. 2B is a front view thereof.
Figure 2A:
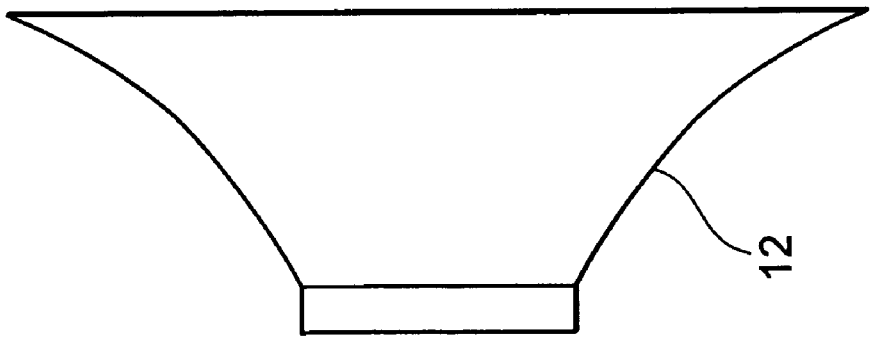

FIG. 2A and FIG. 2B are diagrammatic views of a diaphragm for loudspeaker. FIG. 2A is a side view and FIG. 2B is a front view. In FIG. 2A, a diaphragm material is inserted into a mold, and pressed and heated to form a cone 12 constituting a diaphragm for loudspeaker. With only the cone 12, a diaphragm exhibiting flat reproduction frequency characteristics cannot be obtained. Further, in this case, in the mold for forming the cone 12, a resin flows into the pores formed in the center to the circumference in FIG. 2B for water vapor escape, thus lowering the releasability.

For removing the disadvantage, a sheet material having an internal loss larger than that of the cone 12 constituting the below-mentioned mica paper multi-cellular diaphragm is combined, or the sheet material is combined with the paper article in a mold in the manufacture of the mica paper multi-cellular diaphragm, thus flattening the reproduction frequency characteristics and improving the releasability from the mold.

First, the method for combining with a film or sheet to improve the mica paper multi-cellular diaphragm in internal loss is described. The mica paper multi-cellular diaphragm used here is obtained by the following preparation method.

The procedure for forming a paper article is first described.

Figure 7:
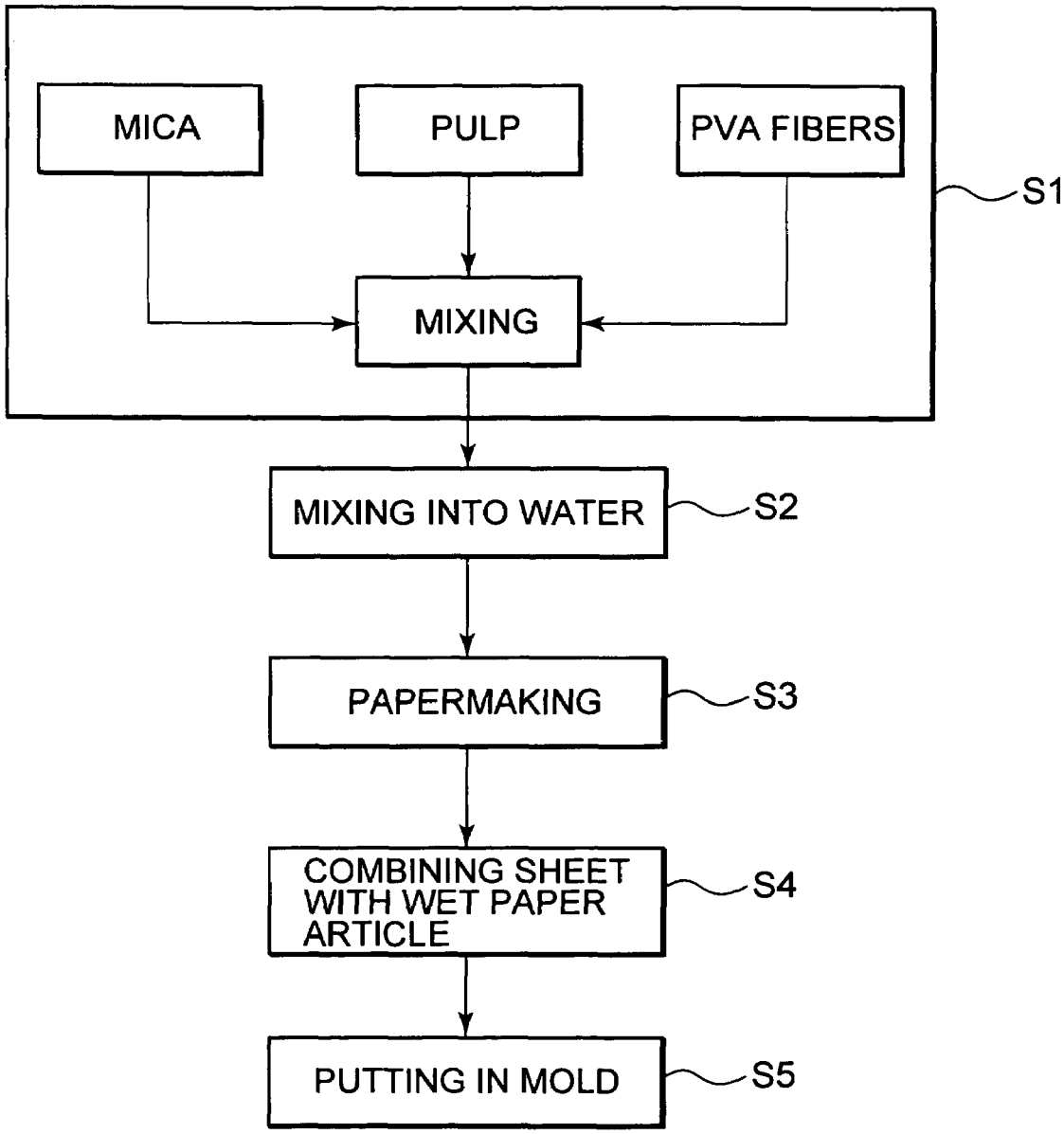
FIG. 7 is a flowchart of forming a paper article and combining a sheet with the paper article.

FIG. 7 is a flowchart for explaining forming a paper article and combining a sheet with the paper article. In FIG. 7, first, three materials, i.e., fine mica flakes, pulp fibers, and polyvinyl alcohol fibers are mixed together (step S1). Mica has a high Young's modulus, pulp has wettability and high strength, and polyvinyl alcohol fibers are water-soluble and have an action such that they are solidified by heating.

Next, the mixed material of mica, pulp, and polyvinyl alcohol fibers mixed together in the step S1 is uniformly dispersed in water (step S2). Then, papermaking is performed using the mixed material of mica, pulp, and polyvinyl alcohol fibers uniformly dispersed in water in the step S2 (step S3). Papermaking is making paper from a water-soluble mixed material while removing moisture from the material to form a plate-form paper article in a moisture state. In this step, a paper machine or the like may be used.

A sheet is combined with the paper article in a moisture state formed in the step S3 (step S4). Only a sheet may be placed in a mold and then combined with the paper article in a moisture state. Finally, the paper article and sheet combined in the step S4 are placed in a mold (step S5).

A sheet material forming the sheet is composed of a material having an internal loss larger than that of a diaphragm base material formed by heating only the paper article. A sheet material composed of a material in the form of non-woven fabric or paper having air permeability, a material in the form of woven fabric having air permeability, or a porous material having air permeability can be used.

In the step S1 above, it is preferred to use the fine mica flakes having a particle size of 8 mesh to 400 mesh. Further, it is preferred to use the pulp fibers and polyvinyl alcohol fibers individually having a length of 3 mm to 100 mm. The respective ranges of the amounts of the above three components incorporated, i.e., fine mica flakes, pulp fibers, and polyvinyl alcohol fibers are shown in Table 1.

TABLE 1

| | Fine mica flakes | Pulp fibers | Polyvinyl alcohol fibers |
|---|---|---|---|
| Parts by weight | 100 | 5 To 50 | 5 To 70 |

The amounts of the pulp fibers and polyvinyl alcohol fibers incorporated vary depending on the physical properties required for the diaphragm manufactured. For example, when the amount of the fine mica flakes is 100% by weight, the amount of the pulp fibers is in the range of from 5% to 50% by weight and the amount of the polyvinyl alcohol fibers is in the range of from 5% to 70% by weight. The mixed material comprised of the three components in the embodiment of the present invention is dispersed in water so that the mixed material concentration becomes 0.1% to 1.0%, and papermaking is performed using the resultant material.

Next, the construction of a mold is described.

Figure 3:
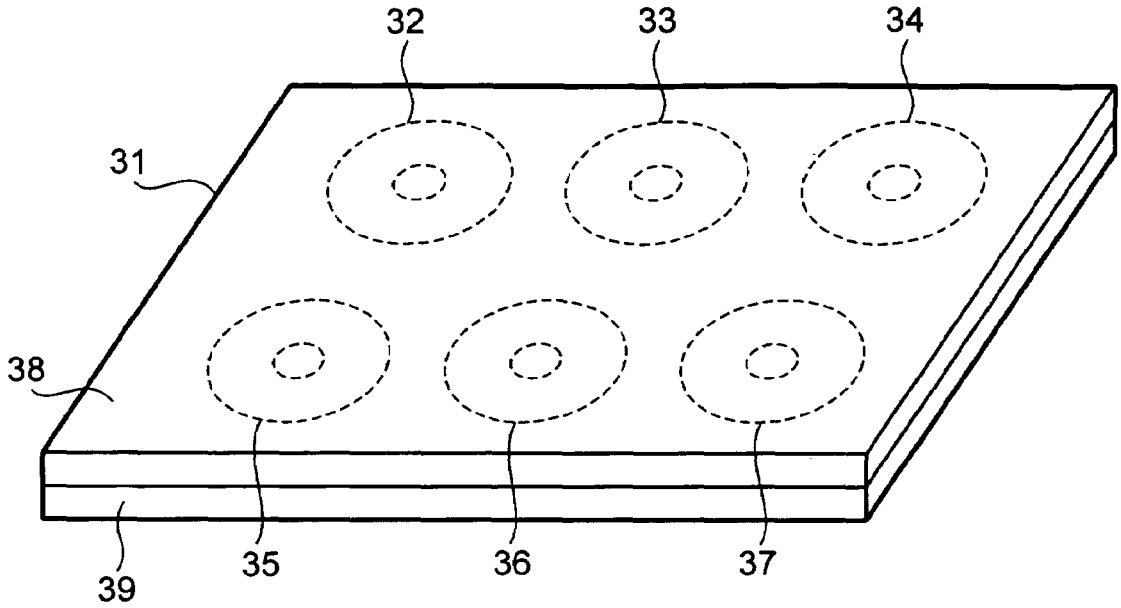
FIG. 3 is a view showing a mold for six pieces.

FIG. 3 is a view showing a mold for, e.g., six pieces. In FIG. 3, a mold 31 is composed of a top half 38 and a bottom half 39, and cone forming portions 32 to 37 for forming diaphragms are provided between the top half 38 and the bottom half 39. The wet paper article and sheet combined in the step S4 in FIG. 7 are placed in the cone forming portions 32 to 37, and the top half 38 and the bottom half 39 are heated while pressing them to form cones constituting mica paper multi-cellular diaphragms.

Figure 4:
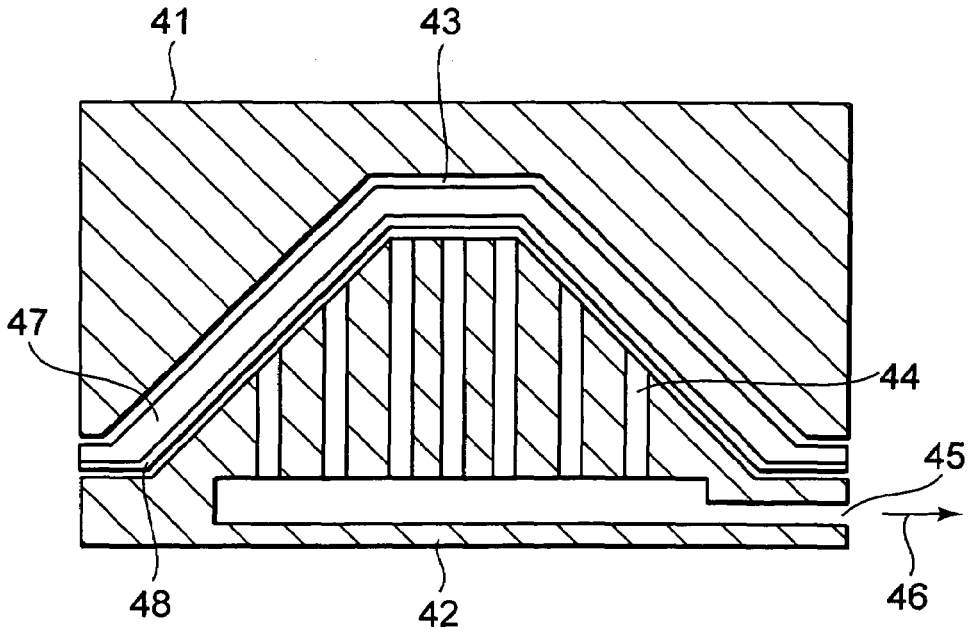
FIG. 4 is a cross-sectional view showing a mold having drying pores formed in one side.

FIG. 4 is a cross-sectional view showing a mold having drying pores formed in one side. FIG. 4 is a partially sectional view of FIG. 3. In FIG. 4, a cone-shaped hole 43 for forming a diaphragm is provided between a top half 41 and a bottom half 42. The wet paper article 47 and the sheet 48 combined in the step S4 in FIG. 7 are placed in the cone-shaped hole 43, and the top half 41 and the bottom half 42 are heated while pressing them, followed by drying. Alternatively, only the sheet 48 may be placed in the mold, and then combined with the paper article 47 in a moisture state.

In this instance, the sheet 48 is attached to the bottom half 42, and the paper article 47 is attached to the top half 41. Only water vapor contained in the paper article 47 is allowed to pass through a plurality of drying pores 44 formed in the bottom half 42 on the cone-shaped hole 43 side, and the water vapor is discharged as indicated by a reference numeral 46 through an open hole 45 formed in the end to communicate with the drying pores 44 formed in the bottom half 42, thus forming a cone constituting a mica paper multi-cellular diaphragm.

Figure 5:
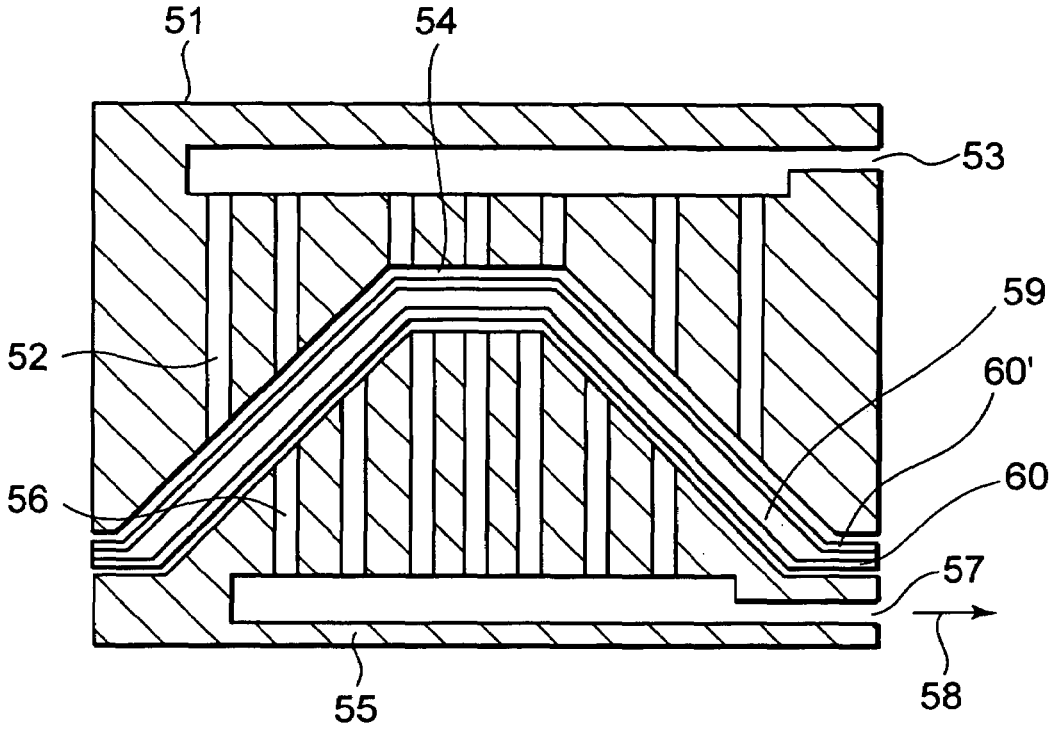
FIG. 5 is a cross-sectional view showing a mold having drying pores formed in both sides.

FIG. 5 is a cross-sectional view showing a mold having drying pores formed in both sides. FIG. 5 is a partially sectional view of FIG. 3. In FIG. 5, a cone-shaped hole 54 for forming a diaphragm is provided between a top half 51 and a bottom half 55. Sheets 60, 60' combined with both surfaces of a wet paper article 59 in the step S4 in FIG. 7 are placed in the cone-shaped hole 54, and the top half 51 and the bottom half 55 are heated while pressing them, followed by drying. Alternatively, only the sheets 60, 60' may be placed in the mold, and then combined with the paper article 59 in a moisture state.

In this instance, the respective surfaces of the sheet 60' and the sheet 60 are attached to the top half 51 and the bottom half 55, and the paper article 59 is attached to the top half 51 and bottom half 55 through the sheet 60' and sheet 60. Only water vapor contained in the paper article 59 is allowed to pass through a plurality of drying pores 52 and a plurality of drying pores 56 formed respectively in the top half 51 and the bottom half 55 on the cone-shaped hole 54 side, and the water vapor is discharged as indicated by a reference numeral 58 through an open hole 53 and an open hole 57 formed in the ends to respectively communicate with the drying pores 52 and drying pores 56 formed in the top half 51 and bottom half 55, thus forming a cone constituting a mica paper multi-cellular diaphragm.

Figure 6:
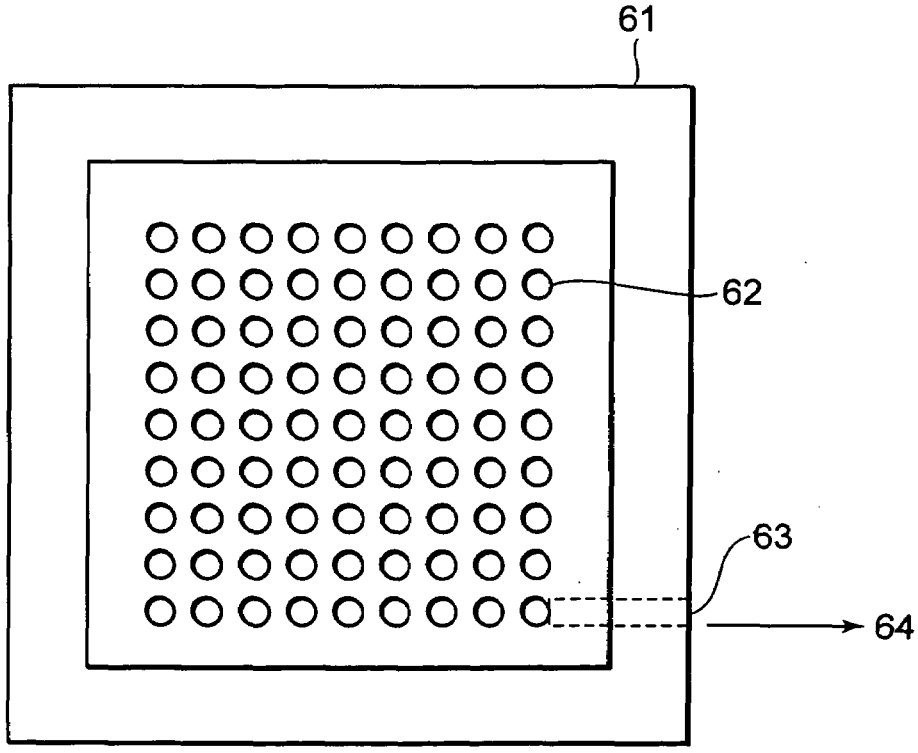
FIG. 6 is a front view of drying pores.

FIG. 6 is a front view of drying pores. FIG. 6 shows the form as viewed from the front of the drying pores 44, or drying pores 52 or drying pores 56 shown in FIG. 4 or FIG. 5. In FIG. 6, a plurality of drying pores 62 are formed in a top half or bottom half 61 in a region defined by the cone-shaped hole 43 or cone-shaped hole 54 shown in FIG. 4 or FIG. 5. Water vapor is discharged as indicated by a reference numeral 64 through an open hole 63 formed in the end to communicate with the drying pores 62.

Next, the procedure for forming a multi-cellular structure diaphragm using the mold and the paper article and sheet combined is described.

Figure 8:
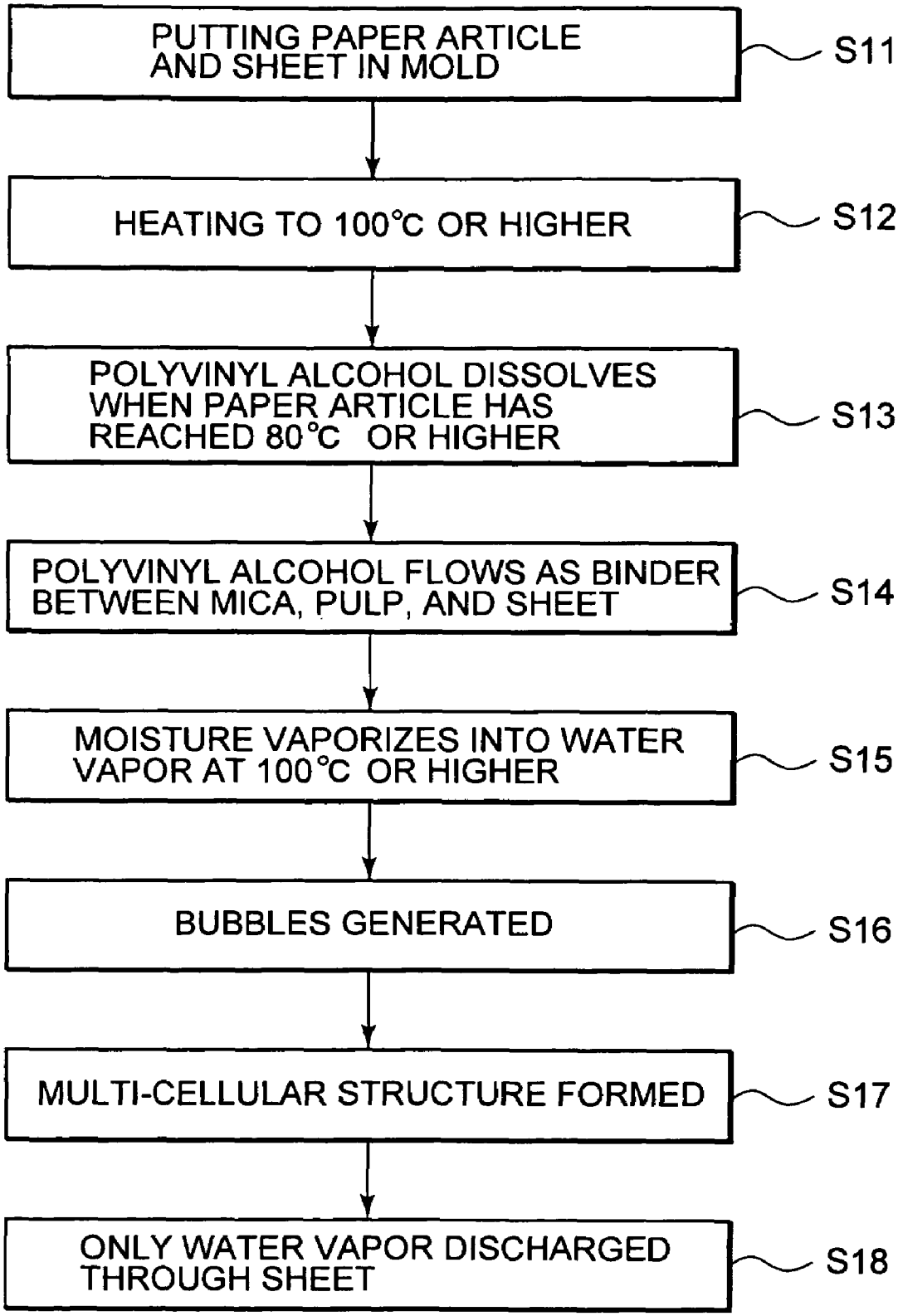
FIG. 8 is a flowchart of forming a multi-cellular structure diaphragm.

FIG. 8 is a flowchart showing the procedure for forming a multi-cellular structure diaphragm. In FIG. 8, the paper article and sheet combined are first placed in a mold (step S11). Then, the mold shown in FIG. 4 or 5 containing therein the paper article in a moisture state in the step S11 is heated to 100° C. or higher while applying a pressure to the mold (step S12).

In heating in the step S12, the heat is transferred from the mold surface through the air-permeable sheet to the paper article in a moisture state, and, at a point in time when the temperature of the paper article has reached 80° C. or higher, the polyvinyl alcohol fibers contained in the paper article are dissolved in water into liquid (step S13).

The polyvinyl alcohol which has changed into liquid in the step S13 flows as a binder between the air-permeable sheet, the fine mica flakes, and the pulp fibers, so that they are bound together (step S14). At this time, the polyvinyl alcohol which has changed into liquid in the step S13 is absorbed by the air-permeable sheet, and hence does not flow into the drying pores, so that the bonding force between the sheet and the paper article is improved, as compared to that obtained in a related art manufacturing method.

When the temperature of the paper article and air-permeable sheet bound by the polyvinyl alcohol in the step S14 has reached 100° C. or higher by heating in the step S12, moisture in the paper article in a moisture state vaporizes into water vapor (step S15). When the moisture in the paper article vaporizes into water vapor in the step S15, a number of bubbles are generated in the paper article (step S16).

Subsequently, a number of bubbles are generated in the step S16 to form a multi-cellular structure (step S17). At this time, only water vapor is discharged through the sheet (step S18). In this way, only water vapor is discharged through the air-permeable sheet in the step S18, and therefore the constituents of the paper article do not flow into the drying pores, so that the releasability is improved, as compared to that in a related art manufacturing method.

As mentioned above, the paper article is dried while dissolving the polyvinyl alcohol fibers contained in the paper article to obtain a mica paper multi-cellular structure article. Further, for increasing the internal loss, a film or sheet material having an internal loss larger than that of a diaphragm composed of the mica paper multi-cellular structure article, for example, a PET (polyethylene terephthalate) film or woven fabric made of Kevlar (registered trademark) is stacked on one side or both sides of the paper article using an adhesive obtained by dissolving the polyvinyl alcohol fibers, thus obtaining a diaphragm composed of a mica paper multi-cellular structure article combined with a film or sheet having an improved internal loss.

Next, the method for combining an air-permeable sheet for improving the internal loss and productivity is described. In the stacking method using an air-permeable sheet, an air-permeable sheet is placed on the surface of the mold shown in FIG. 4 or 5 in which the drying pores are present, and then the paper article in a moisture state is placed in the mold, followed by heating to 100° C. or higher. Thus, both the dissolution of the polyvinyl alcohol fibers and the drying are achieved, obtaining a diaphragm composed of a mica paper multi-cellular structure article.

An alternative method for combining an air-permeable sheet with the mica paper multi-cellular article may be employed in which a diaphragm composed of a mica paper multi-cellular structure article having a sheet combined with one surface is first formed as described above, and then an air-permeable sheet is attached using an adhesive to another surface of the mica paper multi-cellular structure article on which no sheet is present.

An alternative method may be employed in which a diaphragm composed of a mica paper multi-cellular structure article is formed using a sheet for improving the releasability as mentioned above, and then the sheet is peeled off the mica paper multi-cellular structure article and then another sheet for increasing the internal loss is attached to the mica paper multi-cellular structure article using an adhesive.

If, as an air-permeable sheet having an internal loss larger than that of the mica paper multi-cellular diaphragm, for example, nonwoven fabric, paper, or woven fabric made of Kevlar is used, the internal loss can also be improved. Unlike the method using a synthetic resin solution or synthetic resin emulsion proposed related arts, the above method uses neither organic solvent nor surfactant, thus removing environmental problems.

Hereinbelow, specific Experimental Examples of the acoustic diaphragm according to the embodiment of the present invention are shown. Internal loss values of the film and sheet used in the Experimental Examples are shown in Table 2.

TABLE 2

| | PET | Paper | Kevlar woven fabric |
|---|---|---|---|
| Internal loss tanδ | 0.024 | 0.051 | 0.034 |

COMPARATIVE EXAMPLE

First, in a Comparative Example, 100 g of fine mica flakes having a particle size of 8 mesh to 150 mesh, 10 g of pulp fibers, and 60 g of polyvinyl alcohol fibers were dispersed in water to prepare a suspension having a concentration of 0.5%. The suspension of 2,000 g prepared was subjected to papermaking into a size of 100 mm×100 mm. The resultant paper article was inserted into a mold shown in FIG. 4 or 5, which was preliminarily heated to 150° C., and subjected to press drying for 20 minutes to obtain a mica paper multi-cellular structure article having an apparent density of 0.4 g/cm$^3$ and a thickness of 5 mm.

From the thus obtained mica paper multi-cellular structure article, a sample having a length of 80 mm and a width of 10 mm was prepared, and subjected to measurement of the physical properties (internal loss) by a vibrating reed method, and the result of the measurement and the results in the Experimental Examples below are shown in Table 3. As can be seen from Table 3, the internal loss in the Comparative Example was 0.0134.

TABLE 3

| | Comparative Example | Experimental Example 1 | | Experimental Example 2 | | Experimental Example 3 | Experimental Example 4 |
|---|---|---|---|---|---|---|---|
| | | 1-1 | 1-2 | 2-1 | 2-2 | | |
| Internal loss tanδ | 0.0134 | 0.0164 | 0.0182 | 0.0189 | 0.0285 | 0.0175 | 0.0221 |

EXPERIMENTAL EXAMPLE 1

A PET film having micropores and having a thickness of 75 μm was stacked on one side (1-1 in Table 3) or both sides (1-2 in Table 3) of the mica paper multi-cellular structure article obtained in the Comparative Example using a hot-melt adhesive by press bonding at a temperature of 150° C. under a pressure of 1 kg/cm$^2$ for 5 minutes to obtain a PET/mica paper multi-cellular article composite (1-1 in Table 3) or a PET/mica paper multi-cellular article/PET composite (1-2 in Table 3).

A sample having a length of 80 mm and a width of 10 mm was prepared in the same manner as in the Comparative Example, and subjected to measurement of the physical properties by a vibrating reed method. In Experimental Example 1, the composite having PET on one side had an internal loss of 0.0164 as shown at the column "1-1" in Table 3, and the composite having PET on both sides had an internal loss of 0.0182 as shown at the column "1-2" in Table 3, which had been improved, as compared to the above value.

As a PET film, "LUMIRROR" (registered trademark, trade name), manufactured and sold by Toray Industries Inc., was used, and, as a hot-melt adhesive, "DYNAC (registered trademark) PES140-50" (trade name), manufactured and sold by Kureha Ltd., was used.

EXPERIMENTAL EXAMPLE 2

Paper having micropores and having a thickness of 100 μm was stacked on one side (2-1 in Table 3) or both sides (2-2 in Table 3) of the mica paper multi-cellular article obtained in the Comparative Example under the same conditions as those in Experimental Example 1 to obtain a paper/mica paper multi-cellular article composite (2-1 in Table 3) or a paper/mica paper multi-cellular article/paper composite (2-2 in Table 3).

A sample having a length of 80 mm and a width of 10 mm was prepared in the same manner as in the Comparative Example, and subjected to measurement of the physical properties by a vibrating reed method. In Experimental Example 2, the composite having paper on one side had an internal loss of 0.0189 as shown at the column "2-1" in Table 3, and the composite having paper on both sides had an internal loss of 0.0285 as shown at the column "2-2" in Table 3, which had been improved, as compared to the above value.

EXPERIMENTAL EXAMPLE 3

The suspension obtained by mixing the fine mica flakes, pulp fibers, and polyvinyl alcohol fibers similar to those used in the Comparative Example was subjected to papermaking under the same conditions as those in the Comparative Example to obtain a paper article. Kevlar woven fabric having micropores was put on one side of the wet paper article so that the woven fabric was present on the drying pores side of the mold, and inserted into a mold (see FIG. 4), which was preliminarily heated to 150° C., and subjected to press drying for 20 minutes to obtain a Kevlar woven fabric/mica paper multi-cellular article composite. The polyvinyl alcohol which had changed into liquid was absorbed by the Kevlar woven fabric, and hence no polyvinyl alcohol flowed into the drying pores in the mold. Therefore, the composite was easily removed from the mold, that is, the releasability from the mold, which had been poor in related arts, was improved, confirming the effect of the embodiment of the present invention.

As Kevlar woven fabric, Kevlar Cloth K-281 (trade name), manufactured and sold by Arisawa Mfg. Co. Ltd., was used. A sample for measurement was prepared in the same manner as in the Comparative Example, and subjected to measurement of the physical properties by a vibrating reed method. In Experimental Example 3, the internal loss was 0.0175, which had been improved, as compared to the value in the Comparative Example.

EXPERIMENTAL EXAMPLE 4

The suspension obtained by mixing the fine mica flakes, pulp fibers, and polyvinyl alcohol fibers similar to those used in the Comparative Example was subjected to papermaking under the same conditions as those in the Comparative Example to obtain a paper article. Kevlar woven fabric having micropores was put on both sides of the wet paper article, and inserted into a mold (see FIG. 5), which was preliminarily heated to 150° C., and subjected to press drying for 20 minutes to obtain a Kevlar woven fabric/mica paper multi-cellular article/Kevlar woven fabric composite.

Like in Experimental Example 3, in Experimental Example 4, the polyvinyl alcohol which had changed into liquid did not flow into the drying pores in the mold, and thus the releasability was improved, which confirmed the effect of the embodiment of the present invention. As Kevlar woven fabric, Kevlar Cloth K-281 (trade name), manufactured and sold by Arisawa Mfg. Co. Ltd., was used.

A sample for measurement was prepared in the same manner as in the Comparative Example, and subjected to measurement of the physical properties by a vibrating reed method. In Experimental Example 4, the internal loss was 0.0221, which had drastically been improved, as compared to the value in the Comparative Example. As apparent from the results of the measurement, the internal loss in each of the Experimental Examples is larger than that in the Comparative Example, which confirms the effect of the embodiments of the present invention.

EXPERIMENTAL EXAMPLE 5

Using the suspension obtained by mixing the fine mica flakes, pulp fibers, and polyvinyl alcohol fibers similar to those used in the Comparative Example, there were obtained a diaphragm 1, a diaphragm 2 and a comparative example diaphragm, each of which was of a cone type having an opening diameter of 10 cm. The diaphragm 1 is composed of a Kevlar woven fabric/mica paper multi-cellular article diaphragm, that is, a diaphragm having microporous Kevlar woven fabric on one side. The diaphragm 2 is composed of a Kevlar woven fabric/mica paper multi-cellular article/Kevlar woven fabric diaphragm, that is, a diaphragm having microporous Kevlar woven fabric on both sides. The comparative example diaphragm is a diaphragm composed of mica paper multi-cellular article only.

Figure 9:
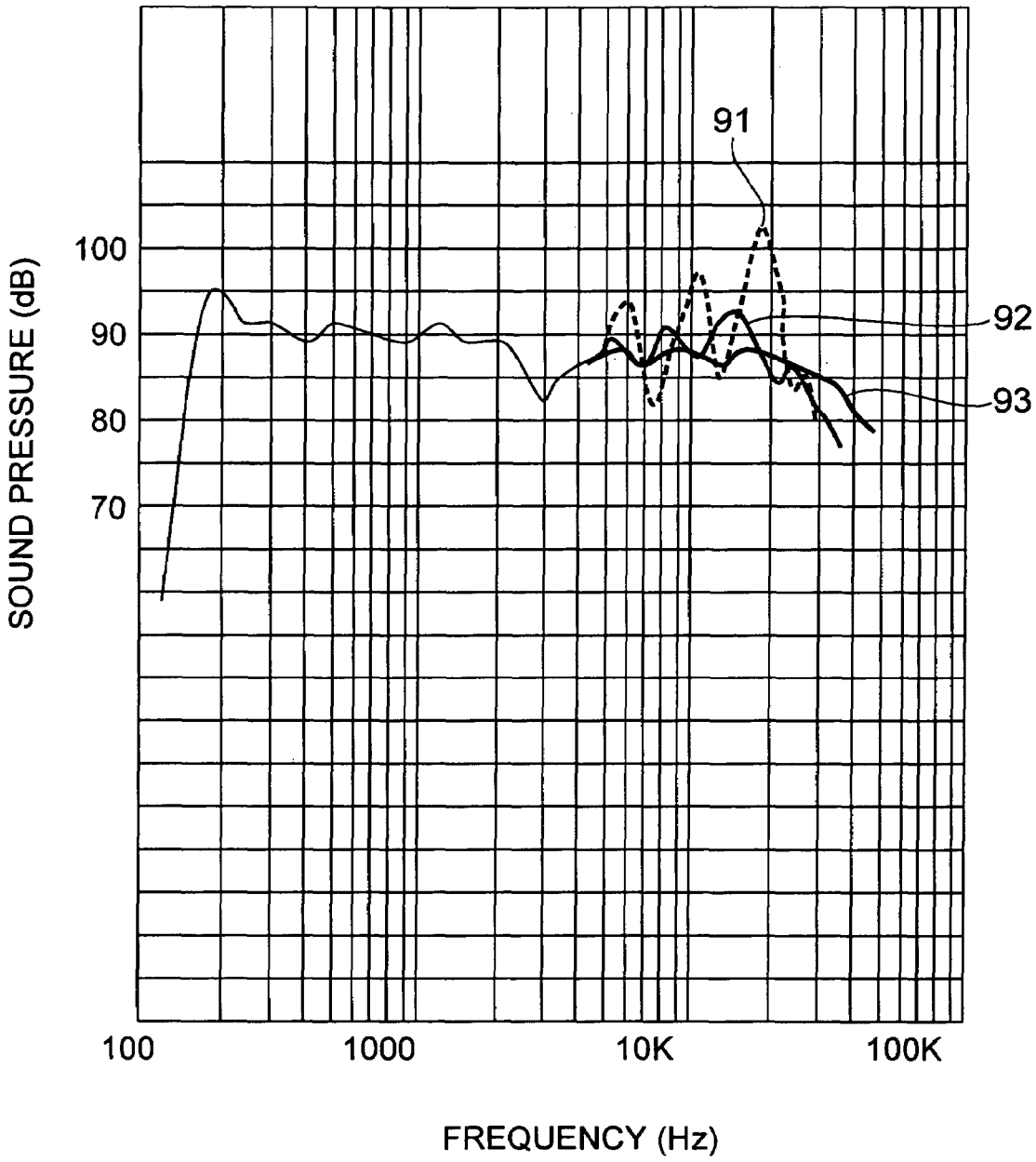
FIG. 9 is a graph of the reproduction frequency characteristics.

FIG. 9 is a graph of the reproduction frequency characteristics. Full-range loudspeakers were individually manufactured using the above-obtained diaphragms, and a comparison was made between the reproduction frequency characteristics of them. From FIG. 9, it is clear that the loudspeaker using the diaphragm 1 or 2 of the present invention indicated by a reference numeral 92 or 93 has flat characteristics having little peak dips, as compared to the loudspeaker using the comparative example diaphragm 91. FIG. 9 has confirmed the increase of the internal loss of the diaphragm.

By the present invention, not only can the internal loss of the multi-cellular acoustic diaphragm be effectively increased to improve the vibration-damping properties, thus achieving flat reproduction frequency characteristics, but also the releasability of the diaphragm from a mold in the production of the diaphragm can be improved, thus enhancing the productivity.

The amounts of the materials for the mica paper multi-cellular article diaphragm, i.e., fine mica flakes, pulp fibers, and polyvinyl alcohol fibers, the drying temperature, and the conditions for the film or sheet are not limited to those in the Experimental Examples, and can be appropriately selected depending on the desired properties of the diaphragm.

The above-described embodiments of the present invention not only can increase the acoustic diaphragm in internal loss to flatten the reproduction frequency characteristics of a loudspeaker but also can improve the releasability of the diaphragm from a mold in the production of the diaphragm, thus effectively enhancing the productivity.

The present invention is not limited to the above embodiments, and the present invention can be changed or modified as long as it is within the scope of the present invention.

What is claimed is:

1. A method for manufacturing an acoustic diaphragm, comprising:

forming a paper article comprised of fine mica flakes, pulp fibers, and polyvinyl alcohol fibers into a convex shape;

combining a first sheet material with said paper article, said paper article being wet during the combining;

after the combining, placing the first sheet material and the paper article in a mold by positioning the first sheet material on a front face of the convex shape of the paper article such that the first sheet material is positioned between the paper article and drying pores in the mold;

heating said paper article and said first sheet material;

forming a diaphragm base material in a multi-cellular structure from said paper article; and discharging only water vapor contained in said paper article through said first sheet material.

2. The method for manufacturing an acoustic diaphragm according to claim 1, further comprising:

before the placing in the mold, combining a second sheet material with said paper article by positioning the second sheet material on a rear face of the convex shape of the paper article.

3. The method for manufacturing an acoustic diaphragm according to claim 1, wherein the drying pores are in a bottom half of the mold, the sheet material is positioned on the bottom half of the mold, and the paper article is positioned on top of the sheet material.

4. The method for manufacturing an acoustic diaphragm according to claim 2, wherein a second set of drying pores is formed in a top half of the mold and the second sheet material is positioned between the paper article and the top half of the mold to form the rear face of the convex shape.

5. An acoustic diaphragm, comprising:

a diaphragm base material comprised of a paper article comprised of fine mica flakes, pulp fibers, and polyvinyl alcohol fibers and formed in a convex shape to be a multi-cellular structure;

a first sheet material combined with said paper article such that the first sheet material forms a front face of the convex shape of the paper article; and a second sheet material combined with said paper article such that the second sheet material forms a rear face of the convex shape of the paper article, wherein the paper article includes a multi-cellular structure formed by a plurality of bubbles generated by binding the paper article between the first sheet material and the second sheet material while the paper article is wet.

6. The acoustic diaphragm according to claim 5, wherein said first sheet material is comprised of a material having an internal loss larger than that of said diaphragm base material.

7. The acoustic diaphragm according to claim 5, wherein said first sheet material is comprised of a material having air permeability.

8. The acoustic diaphragm according to claim 7, wherein said first sheet material is nonwoven fabric or paper.

9. The acoustic diaphragm according to claim 7, wherein said first sheet material is woven fabric.

10. The acoustic diaphragm according to claim 7, wherein said first sheet material is a porous material.

11. The acoustic diaphragm according to claim 5, wherein said fine mica flakes have a particle size of 8 mesh to 400 mesh.

12. The acoustic diaphragm according to claim 5, wherein said pulp fibers and said polyvinyl alcohol fibers individually have a length of 3 mm to 100 mm.

* * * * *